United States Patent [19]

Raymond

[11] 4,409,762

[45] Oct. 18, 1983

[54] ROW STRUCTURE FOR TELESCOPING SEATING SYSTEMS AND METHOD OF ASSEMBLING SAME

[75] Inventor: David W. Raymond, Champaign, Ill.

[73] Assignee: American Seating Company, Grand Rapids, Mich.

[21] Appl. No.: 236,877

[22] Filed: Feb. 23, 1981

[51] Int. Cl.[3] ..... E04H 3/12

[52] U.S. Cl. ..... 52/9; 52/223 R; 297/248

[58] Field of Search ..... 108/108, 109, 27; 52/8, 52/9, 10, 223, 730, 726, 690, 823, 826; 297/236, 248, 252

[56] References Cited

U.S. PATENT DOCUMENTS

| | | | |
|---|---|---|---|
| Re. 29,635 | 5/1978 | McClelland | 52/9 |
| 1,772,694 | 8/1930 | White | 52/726 |
| 2,466,613 | 4/1949 | Richardson | 52/227 |
| 2,646,326 | 7/1953 | Stanitz | 108/27 |
| 3,429,081 | 2/1969 | Robinson | 52/9 |
| 4,000,586 | 1/1977 | Vance | 52/9 |
| 4,041,655 | 8/1977 | Pari | 52/9 |
| 4,054,316 | 10/1977 | DeLong | 52/8 |

*Primary Examiner*—John E. Murtagh
*Assistant Examiner*—Henry E. Raduazo
*Attorney, Agent, or Firm*—Emrich, Lee, Brown & Hill

[57] ABSTRACT

A row construction for a telescoping seating system includes a rear riser beam having a continuous horizontal slot receiving and encapsulating the rear edge of the footrest panel and a nose beam having a similar slot encapsulating the front edge of the footrest panel. The nose beam is then secured to support members which are mounted to the rear riser such that assembly of these members forces the footrest panel under compression into the opposing slots on the front and rear structural beams. Thus, the footrest panel, the front and rear structural beams and the support members form a horizontal truss. The truss construction is extended to corresponding rows of laterally adjacent sections by extending the footrest panel to bridge the joint between these adjacent sections. Thus, the corresponding rows for a number of laterally adjacent telescoping sections are constructed to form a long continuous truss which extends the complete length of the adjacent rows and moves as a unit between the extended and retracted positions.

14 Claims, 6 Drawing Figures

ROW STRUCTURE FOR TELESCOPING SEATING SYSTEMS AND METHOD OF ASSEMBLING SAME

BACKGROUND AND SUMMARY

The present invention relates to telescoping seating systems; and more particularly, it relates to the row structure for a telescoping seating system.

Telescoping seating systems are, of course, well known; and they are in widespread usage in auditoriums, gymnasiums, arenas, and other areas, particularly where a location is desired to be used for more than one purpose. A telescoping seating system includes a number of row assemblies which may be extended for use or retracted for storage. In the use position, the row assemblies are arranged in tiered or stepped relation. That is, in the use position, relative to a lower row, the next rearward row is also higher so that the occupant of the rear row has unobstructed vision.

In the storage position, the rows are arranged in superposed relation—i.e. a lower row is nested beneath the next higher row so that all rows are generally vertically aligned. Although the rows may be interlocked in the use position for stability, the rows are normally independent of one another when they are moved between the use and storage positions. Typically, a lower row is extended first for use, and a lower is also retracted first for storage.

When referred to, the "length" of a row is the overall dimension from the left edge of the row to the right edge of the row when viewed in the position of an occupant, and the "width" is the fore-to-aft dimension (that is, in the direction of motion of the row). Because of the structural aspects of row construction, there are practical limits to the length of the row. A typical row length is in the range of 18–20 feet. Hence, if the dimension in which seating is sought is of the order of 80–100 feet, the rows are arranged in "sections", each section comprising a plurality of rows similar to the other sections, and arranged side-by-side to form the overall seating system. In the past, the seating sections were built in sequence—that is, one section was completed before the construction of the next section. The adjacent ends of corresponding rows were connected together for stability. It is desired, of course, that the corresponding rows of seating sections be horizontally aligned so that the occupant of the fifth row of one section can easily move to the fifth row of an adjacent section without obstruction or any change in the elevation of the footrest panel. Sometimes alignment systems such as tensioned cables and pulleys were used to prevent racking of the rows.

There has been a lot of design, engineering and testing in row structures for telescoping seating systems, and they have grown to be fairly sophisticated structures. To be considered, for example, is the fact that the same basic row structure is used for heights ranging from a foot or so to over thirty feet above the floor. Further, loading varies widely, and safety is of paramount importance and perhaps the more important design criterion in these systems.

Also to be considered are the various seating treatments which a manufacturer desires to offer to the market. These treatments vary according to use, cost and so on. In the past, the types of row structures have been classified into two major classes depending upon the seating offered. A bleacher type of structure which offers conventional bench type seating typically has that seating secured to the row structure and forming an integral part of it. The seating does not move relative to the row structure whether the row is in the use position or in the storage position. A second type of row structure, sometimes referred to as a chain platform structure, permits a wider variety of seating to be offered, and in this type of structure, the structure of the row is generally thought of as being independent of the particular seating.

In general terms, each row includes an understructure which typically may have two posts or columns which determine the height of the row structure, strapping or braces holding the columns together, and a wheel carriage at the bottom of each column permitting the structure to be moved along a floor. Modern row sections typically employ a metal riser beam connected to the top of the columns and forming the rear structural beam of the deck portion of a row structure. The deck also includes footrest panels which may be supported along their rear edges by a flange of the riser beam and forwardly projecting arms or supports also attached to the riser beam. The deck structure is typically cantilevered from the posts or columns of the understructure, and it may include, in the case of a chair platform structure, a forward structural member extending the length of the row structure and supporting the footrest panel, sometimes referred to as a nose beam.

The present invention relates particularly to the deck construction of the row structure for telescoping seating systems, and to the method of assembling the row structure. It has the particular advantage of forming an integral horizontal truss from the elements of the deck structure wherein the horizontal truss extends continuously for all corresponding rows of adjacent seating sections. This permits all corresponding rows to be moved as a unit between the extended and retracted positions, and it provides enhanced rigidity to the overall row structure.

A continuous horizontal slot is formed at the base of the rear riser beam and cooperates with the lower flange of that beam to receive and encapsulate the rear edge of the footrest panel. A similar encapsulating slot is provided by the nose beam for receiving the forward edge of the footrest panel. Support members are secured to the rear riser beam and extend forwardly beneath the footrest panels. The nose beam is secured to these support members by means of threaded fasteners. The width of the footrest panel (that is, the forward to rear dimension) is slightly greater than the corresponding dimension defined by the encapsulating slots when the nose beam is assembled to the support members. Thus, as the nose beam is fastened to the support members, with the edges of the footrest panels held by the encapsulating slots, the footrest panels are compressed. The footrest panel, the front and rear structural beams and the support members thus form a horizontal truss. This truss is continued between corresponding rows of laterally adjacent seating sections by extending the footrest panel to bridge across the joint between these adjacent sections. Thus, the horizontal truss is continuous and extends the complete length of the laterally adjacent rows. This truss is moved as a unit between the extended and retracted positions, and it adds a structural rigidity to the overall section which extends to adjacent sections.

The provision of a continuous horizontal truss of the type described herein has an advantage in systems which are extended and retracted using floor-engaging power units. Depending on the number and length of rows in the sections, it may be possible to reduce the number of power units, which normally are provided for each section, so that, for example, four power units may be employed for five sections. The rigidity of the horizontal truss which incorporates the footrest panel permits the rows of the section without the power unit to be carried along by the rows of the sections which are powered. Another advantage of the inventive system is the possibility of eliminating auxiliary alignment systems such as have been used in the past to prevent racking of the rows.

In the illustrated embodiment, the encapsulating slot on the rear riser beam is provided by forming a rib in the vertical web of the beam above its lower flange so that the rear surface of the slot is defined by the vertical web of the riser beam. By forcing the footrest panel into that slot under compression, the rear edge of the footrest panel is forced into engagement with a portion of the vertical web of the riser beam; and this structure maintains the web of the riser beam in a vertical plane and resists any tendency of the riser beam to twist or buckle under load. Thus, the structural rigidity of the riser beam is enhanced.

The nose beam is preferably an extruded metal form defining a forwardly opening slot which receives the hardware for fastening the nose beam to the forwardly projecting support members beneath the footrest panel, and an upwardly opening slot for mounting the seating. In this manner, the seating can be any one of many different varieties such as benches, individual chairs or ganged seating modules; and for each seating treatment, the seating can be adjusted and aligned so as to provide aisles at any desired location. Of great importance to the user is the fact that these aisles are formed at the footrest level (that is, the tread of the aisle is the same as the footrest panel for the row structure). In some prior commercial systems, the location of an aisle at the footrest level could not be changed without modifying the deck structure of a row.

Other features and advantages of the present invention will be apparent to persons skilled in the art from the following detailed description of a preferred embodiment, accompanied by the attached drawing wherein identical reference numerals will refer to like parts in the various views.

THE DRAWING

DETAILED DESCRIPTION

Figure 1:
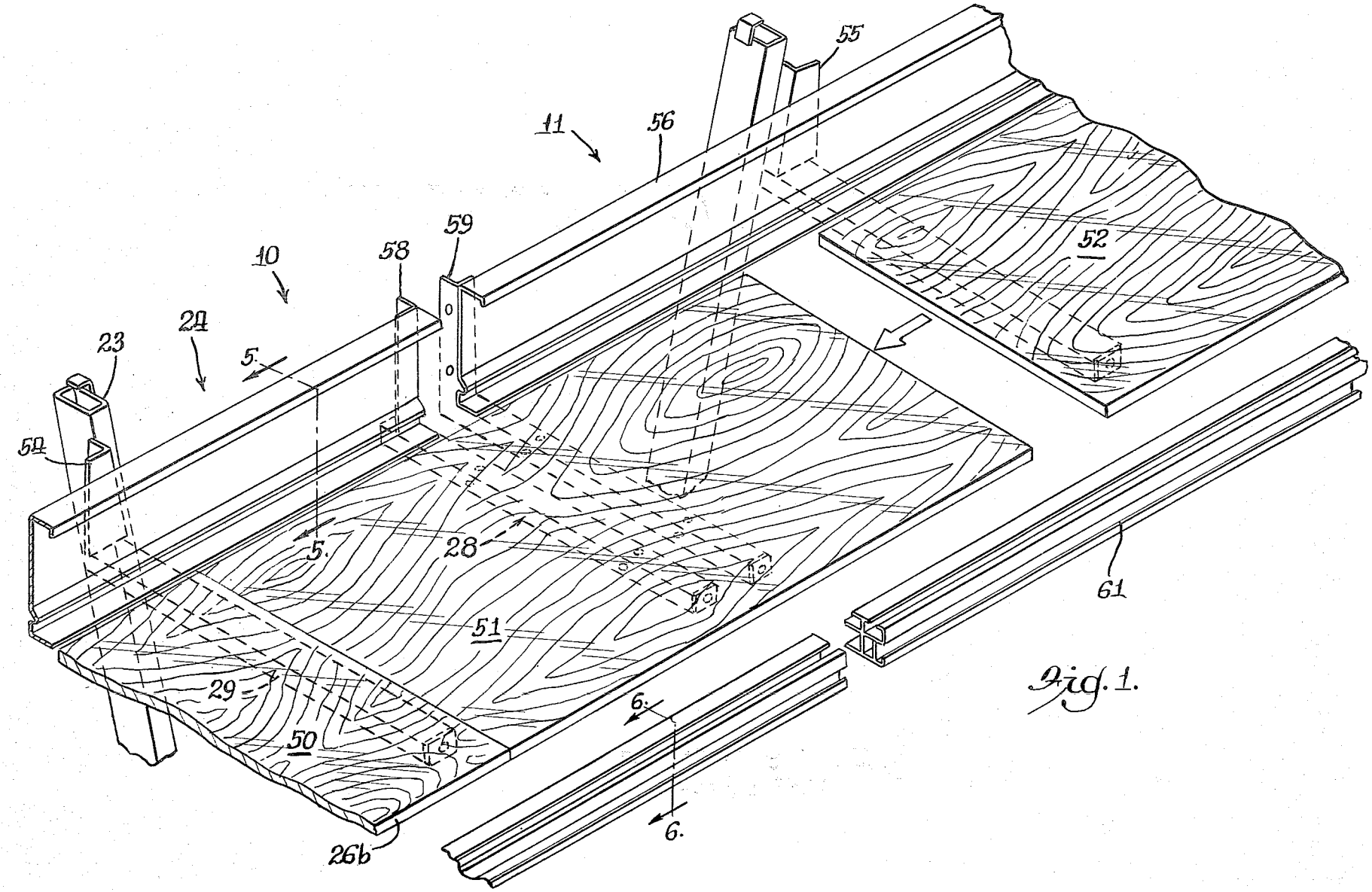
FIG. 1 is an upper frontal fragmentary perspective view of the adjacent portions of two laterally adjacent rows in a telescopic seating system constructed according to the present invention, with the elements in exploded relation.

Referring first to FIG. 1, there is shown the right hand portion of a first row generally designated 10 and the left hand portion of the corresponding row generally designated 11 in the laterally adjacent seating section. It will be understood that each seating section includes a number of similar rows, differing only in their height, and adapted to be nested one beneath the other in a retracted or storage position, yet movable to an extended or use position in which the rows are stepped or tiered. One prior telescoping seating system is disclosed in the co-owned U.S. Pat. No. 3,667,171, issued Jan. 6, 1972 of McClelland and Raymond for ROW SEATING STRUCTURE, reissued May 23, 1978, Re. 29,635.

Figure 3:
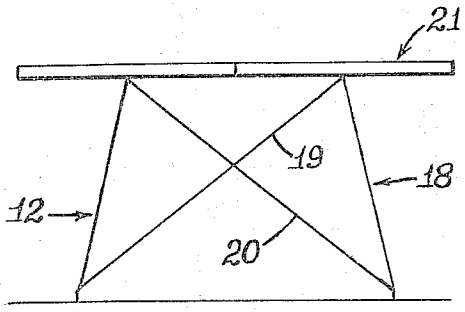
FIG. 3 is a diagrammatic front view illustrating the configuration of a preferred under structure or frame for a row.
Figure 4:
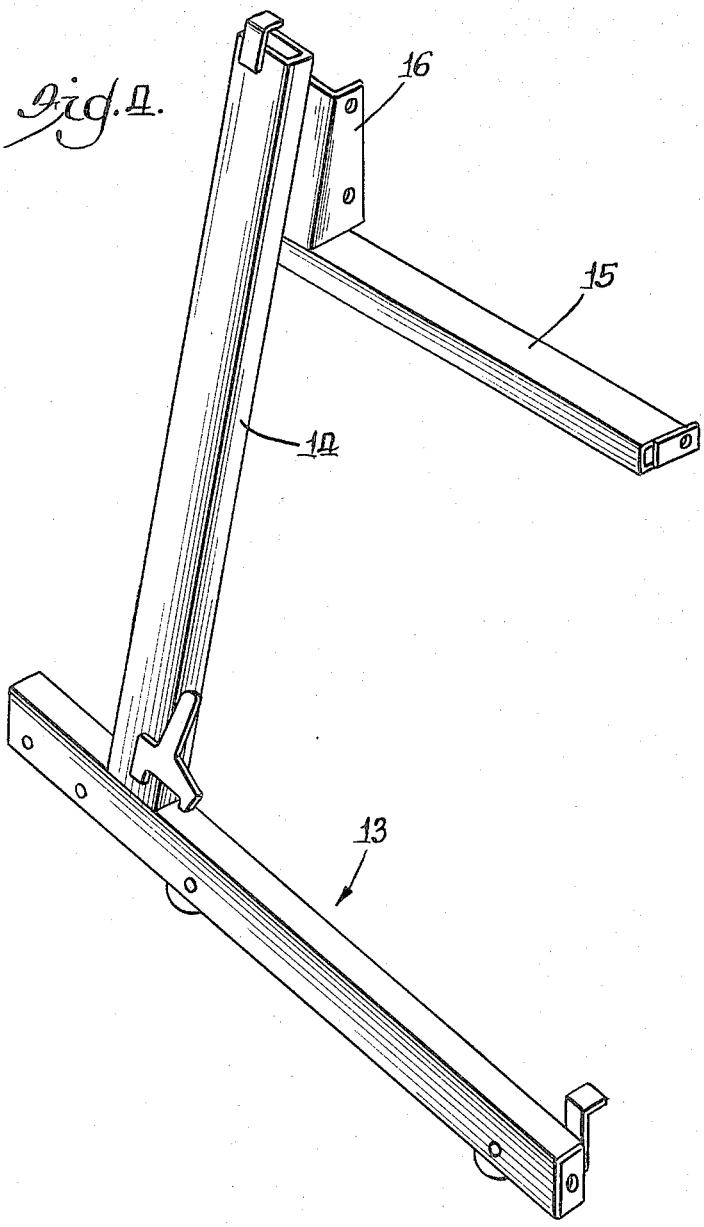
FIG. 4 is an upper frontal perspective view of one side of an understructure for a row.

Briefly, each row of a telescoping seating system includes an understructure and a deck or platform which is mounted to the top of the understructure. A typical understructure includes a pair of post assemblies, a typical left side (when viewed from the front) post construction being seen in FIG. 4 and generally designated 12. The post construction 12 includes a wheel carriage 13, a post or column 14 welded to the top of the wheel carriage 13, and including a forwardly projecting cantilever arm or support 15 and an angle bracket 16. The post 14 is arranged to slant inwardly toward the center of the structure. Referring briefly to FIG. 3, it includes the left side post assembly 12 shown diagrammatically and a complementary post assembly on the right side, generally designated 18 which, of course, is also provided with a wheel carriage. A pair of braces which may be in the form of flat steel straps 19, 20 interconnect the post assemblies 12, 18 for rigidity. A deck or platform generally designated 21 is connected at the top of the post assemblies by means of the brackets such as that designated 16, and it is at least partially supported by the cantilever support arms, such as that designated 15 in FIG. 14.

As diagrammatically illustrated in FIG. 3, the posts of the post assemblies 12, 18 are slanted inwardly as they extend upwardly. The reasons for this and the advantages flowing from the construction, as well as additional structural detail may be found in U.S. Pat. No. 4,041,655 of Pari, issued Aug. 16, 1977 for TELESCOPING SEATING SYSTEMS, also co-owned.

Returning then to FIG. 1, a right side post or column 23 can be seen in fragmentary form, and it is a part of the understructure for the row 10 of the left telescoping section. The deck of the row 10 is generally designated 24, and it includes a rear riser beam 25, a footrest panel generally designated 26, a forward structural beam 27 called the "nose" beam, and a support member beneath the footrest panel which is seen in phantom and designated 28. A cantilever support arm 29 is welded to the column 23 and is similar to the previously described cantilever arm 15 of FIG. 4. The support member 28 is similar in function to the cantilever arm 29 except that the support member 28 is connected to and cantilevered from the riser beam 25, whereas the cantilever arm 29 is welded to the column or post 23 of the understructure. Both elements act to interconnect the nose beam 27 with the riser beam 25, and to support the footrest panel when it is placed under load.

Each of the elements described in connection with the row 10 is similar to the corresponding element in row 11, so that the row 11 need not be described in further detail for an understanding of the invention.

Figure 5:
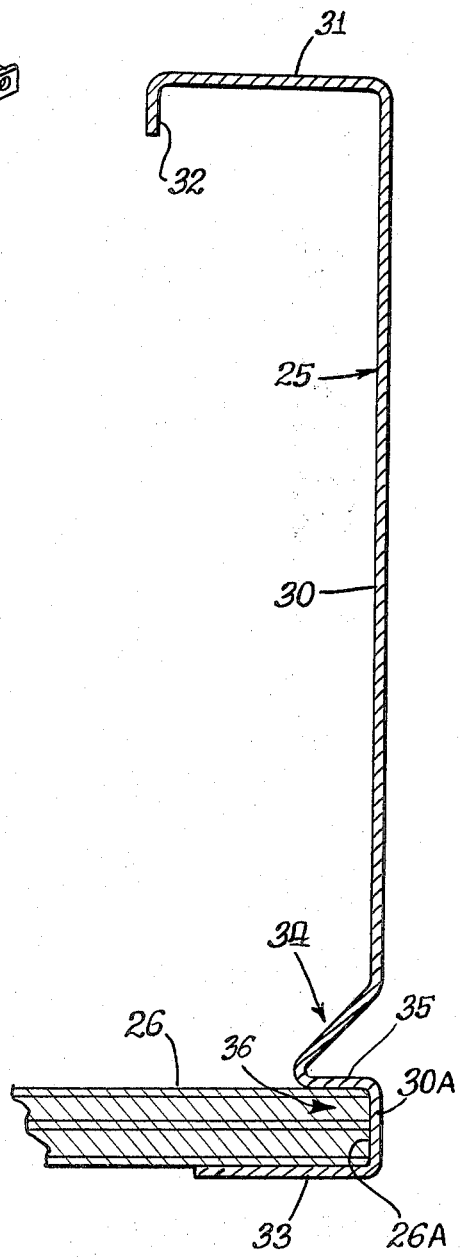
FIG. 5 is a vertical sectional view of a preferred riser beam incorporated into the present invention and showing a footrest panel in fragmentary form.

Turning now to FIG. 5, the rear riser beam 25 is seen in cross section as including a vertical web 30, an upper horizontal flange 31, the forward portion of which is turned downwardly at 32 to provide a stiffener, and a lower, forwardly-projecting flange 33. The lower portion of the web 30 is formed into a rib-like forward projection 34 which includes a lower horizontal portion 35 spaced above the lower horizontal flange 33 of the beam to form a continuous horizontal slot generally designated 36 for receiving the footrest panel 26. Thus, the slot 36 is defined by the lower horizontal flange 33, the lower portion of the vertical web 30 (designated 30A) and the horizontal portion 35 of the rib 34 formed in that vertical web. As will be explained in further detail, the footrest panel 26 is forced under compression into the slot 36 so that the slot 36 receives and encapsulates the rear edge of the footrest panel 26.

It is considered an important feature of the invention that when the rear edge 26A of the footrest panel is forced against the abutting surface of the portion 30A of the vertical web 30 of the riser beam 25, it maintains that web in its vertical panel, thereby adding to its structural integrity by resisting buckling forces in the riser beam as the row is placed under load due to the presence of occupants on the deck. In other words, the load bearing capacity of the riser beam 25 is at its greatest when the vertical web 30 is maintained in its normal vertical plane, and in this structure, the rear edge of the deck panel is forced against the web to insure that it does not buckle out of the vertical plane. The strength of the riser beam 25 is further enhanced by increasing its resistance to vertical deflection by providing that the height of the encapsulating slot 36 must be such as to snugly receive the footrest panel 26. Any tendency of the beam 25 to deflect in a vertical plane thereby causes the rib 34 to be forced against the material of the footrest panel 26, the lower surface of which is held by the flange 33. This deflection would thus be resisted by compression of the rear portion of the footrest panel 26 which fills the encapsulating slot 36.

Figure 6:
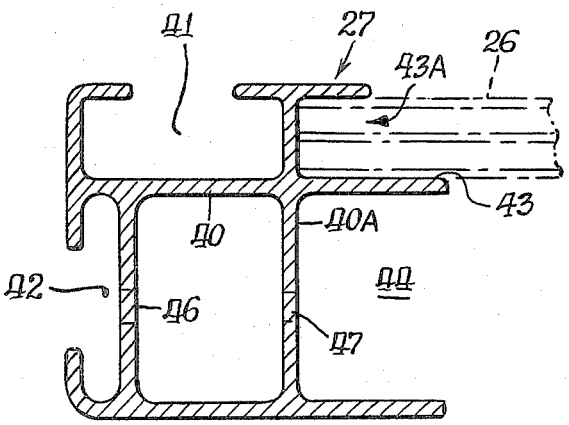
FIG. 6 is a vertical sectional view of a preferred nose beam extrusion.

Turning now to FIG. 6, the nose beam 27, preferably formed as an extrusion of aluminum, is seen to include a rectangular or box-shaped beam 40, an upwardly accessible upper slot 41, a forwardly accessible front slot 42 and upper and lower rear accessible slots 43, 44. The slot 41 is used for mounting seating, as will be described. The slot 42 is used for receiving hardware for securing the nose beam 27 to the forwardly-projecting support members 28, 29. A shouldered lag bolt (see 45 in FIG. 2) is received in the slot 42 and extends through an aperture 46 in the forward wall of the box beam 40 and a smaller, aligned aperture 47 in the rear wall thereof to be threadedly received in an internally threaded plate such as that designated 48 in FIG. 2 which is welded in this instance to the forward end of a support arm 28. Thus, the lower rear slot 44 of the nose beam receives the forward portion of the support arms 28 and cantilever members 29, both of which are provided with threaded plates for receiving the lag bolts 45.

The upper rear slot 43 of the nose beam extrusion forms an encapsulating slot which opposes or faces the corresponding encapsulating slot 36 on the riser beam 25, and is also horizontally aligned with it for receiving the forward edge 26B of the footrest panel 26. The width of the footrest panel material is slightly larger than the distance between the forward wall of the slot 44 (actually the rear wall 40A of the box beam 40 in the illustration of FIG. 6) and the portion 30A forming the rear wall of the opposing encapsulating slot 36. In this manner, when the bolts 45 are threaded into the support members, the material of the footrest panel is placed in compression. This also insures that the forward and rear edges of the footrest panel are forced into the encapsulating slots so that no additional hardware is needed to secure the footrest panel material to the deck of the row. As an example, if sheets of plywood having a thickness of $\frac{5}{8}$ in. are used for the footrest material, and it has a nominal width of 30 in., the width of the panels are cut $\frac{1}{8}$ in. larger than the distance between the wall 40A of the nose beam and the portion 30A of the rear encapsulating slot 36.

As best seen in FIG. 1, the footrest panel material may be provided in a number of individual sections, such as those designated 50, 51 and 52. Because the footrest panels are clamped and encapsulated as described above, and no fasteners are required to secure the footrest panels either to the support members 28, 29 or to the forward or rear structural beams, the construction of the present invention does not require that the footrest panel sections be cut to any required length. Thus, a price advantage may be achieved by ordering such panel sections to a length which is in greater supply.

Still further, and considered to be a principal advantage of the present invention, is that one of the footrest panel sections bridges the joint between corresponding rows of adjacent seating sections. In the illustrated embodiment, the footrest panel 51 bridges the joint between laterally adjacent rows 10 and 11. The forward and rear encapsulating slots on the riser beams and nose beams respectively are horizontally aligned as a necessary result of the structure.

Still referring to FIG. 1, the assembly of the illustrated structure will now be described. The rows are assembled in the order proceeding from front to rear—that is, the lowest row is assembled first and then the process proceeds to the next higher row. After the understructures are assembled in accordance with the established procedure, riser beams are fastened to their associated understructures. The cantilever arms 29 are normally provided as an integral part of the understructure so there is no need to assemble them at this time, but they can be used to support the riser beams while the riser beams are being assembled to their associated brackets such as those designated 54, 55 in FIG. 1 for the riser beams 25, 56 respectively. Next, the support members 28 are assembled to the riser beams. The rear end of each of the support members 28 is provided with an upwardly extending angle member, see the angle members 58 in FIGS. 1 and 2. The angle members are bolted to the vertical webs of their associated rear riser beams. Although it is not necessary, it is desirable that support members 28 be placed at the side edges of their associated riser beams so that support members associated with laterally adjacent rows may also be fastened together with bolts to supply additional rigidity to the completed structure. To facilitate this, the angle members 58 are arranged to have their flanges adjacent one another for laterally adjacent sections, as seen for the angle members 58, 59 in FIG. 1. Suitable apertures are provided in the angle members and the support arms for receiving bolt fasteners.

Next, the panel sections 50, 51 are placed into the rear encapsulating slots, and the nose beams are loosely assembled with their associated slots encapsulating the front edge of the panel sections. With one panel section (51) bridging the joint between the adjacent rows 10, 11, the nose beam 27 for the left side row 10 is assembled to its associated support members and cantilever arms by means of the bolts 45, described above. The laying of footrest panel sections is continued by placing the rear edge in the encapsulating slot of the riser beam 56 and bringing the left edge of the panel section 52, for example, into abutting relation with the right edge of the panel section 51, until, again, a panel section bridges the joint off the plane of the page of FIG. 1 to the right. When that is complete, the nose beam 61 is fastened to the support arms and cantilever arms of the deck of the row 11.

The elements including the riser beam, support members, footrest panel sections and nose beam, when thus assembled, form a horizontal truss which employs the strength of the footrest panel material to great advantage by compressing it. Further, this truss is extended and continued to the corresponding row of the laterally adjacent seating section by bridging the joint between them with the footrest panel and by connecting the support structures together as described. The entire set of corresponding rows for a very large installation may thus be moved to and from the use position while employing conventional separate power means for each seating section. These power means are typically connected to the lowermost row, as is known in this art.

A still further advantage of the construction described above is that by forcing the rear edge of the footrest panel material into the encapsulating slot of the riser beam and by compressing the panel material, as already mentioned, the footrest panels engage the vertical web (section 30A in FIG. 5) and maintain that web in its intended vertical plane when the row is placed under load.

Figure 2:
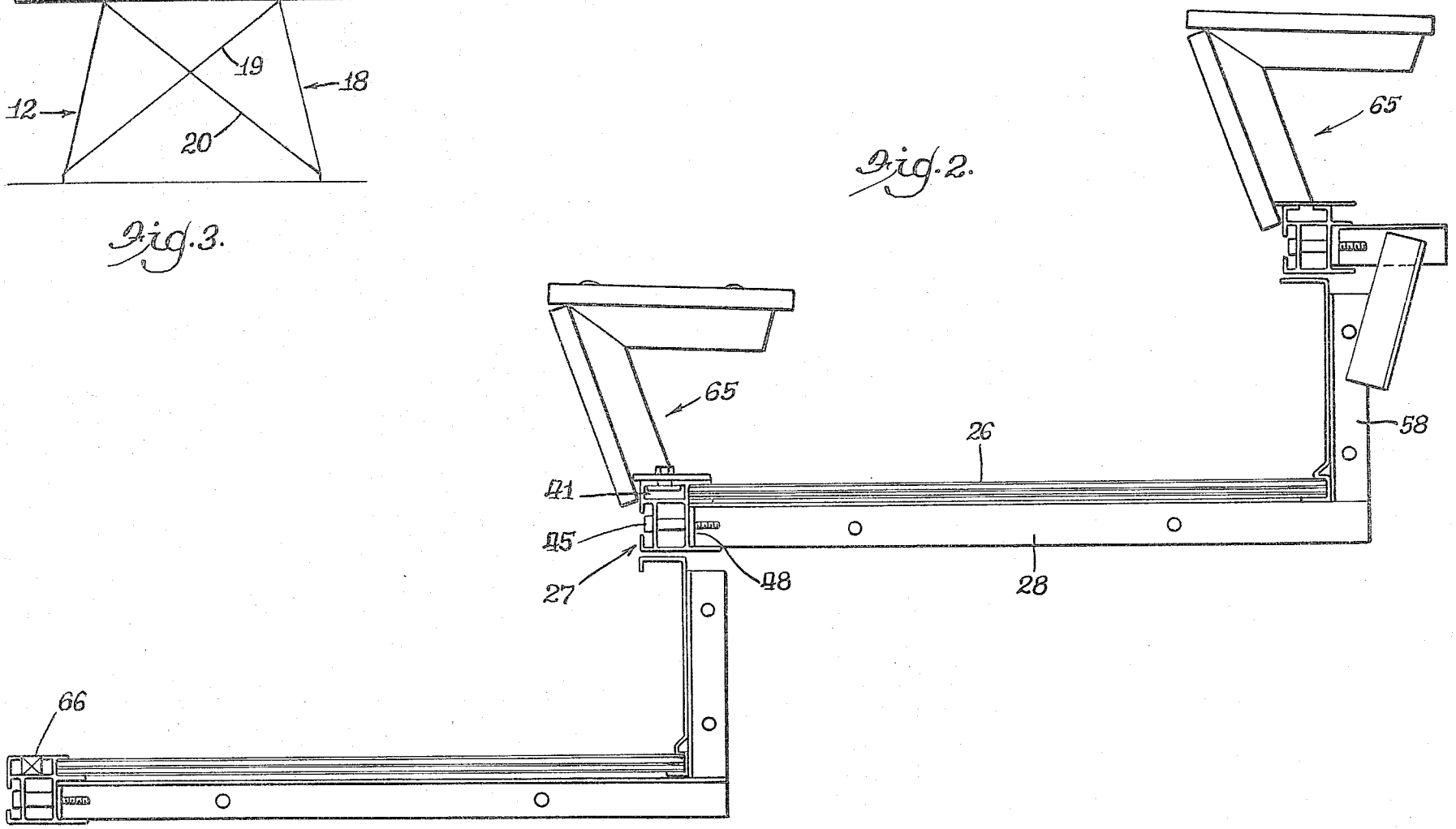
FIG. 2 is a side elevational fragmentary view of a number of rows in the same section in extended or use position.

Referring now to FIG. 2, it can be seen that the upwardly opening slot 41 of the nose beam 27 may be used to receive quarter turn hardware in securing seating 65 to the forward edge of the deck. In the illustrated embodiment, the seating 65 takes the form of bench or bleacher-type seating, but other types of seating, such as individual chairs or ganged seating could equally well be employed.

In this manner, it can be seen that the seating may be located at any lateral position along the deck because its attachment to the deck is not dependent upon the location of any structural members such as the support members 28, but only upon the continuous slot 41. The seating can even bridge across the joint between laterally adjacent rows.

This permits the formation of aisles at the footrest levels without modifying the structure, and independent of the location of the underlying support members, as just discussed. Where the seating is not provided, the slot 41 is provided with filler material, such as a plastic extrusion, as illustrated at 66 for the lower row. The other exposed slots may equally well be closed in this manner.

Having thus disclosed in detail a preferred embodiment of the invention, persons skilled in the art will be able to modify certain of the structure which has been illustrated and to substitute equivalent elements or steps for those disclosed while continuing to practice the principles of the invention. It is therefore intended that all such modifications and substitututions be covered as they are embraced within the spirit and scope of the appended claims.

What is claimed is:

1. In a telescoping seating system including a plurality of rows adapted for movement between an extended use position in which the rows are in tiered relation and a retracted use position in which the rows are in nested relation and generally vertically aligned, each row including an understructure and a deck carried by said understructure, the improvement comprising: a riser beam attached to the upper portion of said understructure and including a first panel receiving slot; footrest panel material having a rear edge received and held by said first slot of said riser beam and including a forward edge, said panel material being continuous from said rear edge to said forward edge; a structural nose beam defining a second slot opening in a horizontal direction toward the rear of said system and receiving the forward edge of said footrest panel material; connecting arms for connecting said nose beam to said riser beam; and fastener tightening means securing said nose beam to said connecting arms for forcing said rear and forward edges of said panel material respectively into tight engagement with said first and second slots on said riser beam and said nose beam respectively to thereby clamp said footrest panel material against the web of said riser and to force said panel material against vertical movement by said first and second slots, said panel material being in compression in a fore-and-aft direction against a corresponding tensile force in said arms and thereby forming an integral part of a horizontal truss together with said riser beam, said nose beam and said connecting arms.

2. The apparatus of claim 1 wherein said first slot comprises a horizontal encapsulating slot on said riser beam opening toward the front of said deck and arranged to receive said panel material in horizontal disposition.

3. The apparatus of claim 2 wherein said first slot of said rear riser beam is partially defined by the vertical web of said beam such that the rear edge of the panel material received in said encapsulating slot is forced into tight and continuous engagement with the vertical web of said beam.

4. The apparatus of claim 3 characterized in that said engagement between the vertical web of said riser beam and said rear edge of said footrest panel material is continuous across the horizontal extension of said web.

5. The apparatus of claim 3 wherein said first slot of said riser beam is defined on its lower edge by a horizontal flange of said riser beam.

6. The apparatus of claim 5 wherein the vertical web of said riser beam defines a forwardly projecting rib providing the upper edge of said first slot and including a horizontal portion spaced above said lower flange of said riser beam by a distance sufficient to receive said rear edge of said footrest panel material in snug engagement such that said panel material fills the vertical extension of said first slot to thereby cause deflection of said web to be resisted by compression of said panel material.

7. The apparatus of claim 1 wherein said nose beam defines at its upper rear portion, said rearwardly opening second slot receiving and encapsulating the forward edge of said footrest panel material and including a vertical wall portion for engaging the forward edge of said footrest panel material and forcing said panel material into compression against the vertical web of said riser beam.

8. The apparatus of claim 7 wherein said connecting arms include a plurality of support members connected to said riser beam and extending beneath said footrest panel material and including a threaded portion at the forward end thereof; and a plurality of bolts, each fastening said nose beam to an associated threaded portion of one of said support members.

9. The apparatus of claim 8 wherein said first slot of said riser beam comprises an elongated rear slot defined at its rear by the vertical web of said riser beam, and said second slot on said nose beam provides an elongated forward slot receiving the forward edge of said panel material, and wherein the width of the footrest panel material is slightly greater than the distance between the far edges of said rear and forward slots when said nose beam is assembled to said riser beam by said connecting arms, such that said panel material is placed in compression and rigidly held by said respective slots of said riser beam and said nose beam.

10. The apparatus of claim 7 wherein said nose beam further comprises a continuous horizontal upper slot communicating through the upper surface thereof, said apparatus further including seating means secured to said deck by means of a fastener secured in the upper slot of said nose beam, whereby the lateral placement of said seating means is independent of the understructure of said deck and the placement of said support means, and an aisle can be formed at the footrest level of said deck independent of the supporting structure of said deck.

11. An improved deck structure for interconnecting corresponding rows of first and second telescoping seating sections placed side-by-side, each section comprising a plurality of rows movable between extended and retracted positions, each row including a movable understructure and a deck carried by said understructure, said decks of said corresponding rows each comprising: a rear riser beam connected to said understructure and extending the length of a row and including first slot receiving means, said riser beams and said slot receiving means of said corresponding rows of adjacent sections being horizontally aligned and adjacent one another; a plurality of footrest panels laterally abutting one another to form a continuous footrest for said deck and having rear edges received in snug engagement in said slot receiving means of said riser beam and extending forwardly thereof; a nose beam defining second slot receiving means for each deck receiving and holding the forward edge of said panels for said deck; one of said panels extending across the joint between laterally adjacent riser beams of different sections into said slot receiving means of said adjacent riser beams and nose beams of said corresponding rows; and tensioned connecting means for connecting the nose beam of each deck to the riser beam thereof and for forcing the rear and forward edges of said panels into snug engagement respectively with said first and second slot receiving means and thereby to clamp and compress said panels, whereby a continuous horizontal truss is formed by said riser beam, nose beam, footrest panels and connecting means, and said truss extends to said corresponding rows of said laterally adjacent sections.

12. The apparatus of claim 11 further comprising means for securing together the connecting means of laterally adjacent rows to further strengthen said horizontal truss.

13. The apparatus of claim 10 wherein said first slot receiving means of said riser beam is a continuous horizontal slot at least partially defined by the web and lower flange of said riser for encapsulating the rear edge of said panels and defined by the lower horizontal flange of said riser beam, a portion of the vertical web of said riser beam, and a rib on said riser beam.

14. The apparatus of claim 13 wherein said second receiving means of said nose beam comprises a continuous horizontal slot formed in the upper portion of said nose beam and opening toward the rear of said deck and horizontally aligned with the encapsulating slot of said riser beam.

* * * * *

UNITED STATES PATENT AND TRADEMARK OFFICE

CERTIFICATE OF CORRECTION

PATENT NO. : 4,409,762

DATED : October 18, 1983

INVENTOR(S) : David W. Raymond

It is certified that error appears in the above—identified patent and that said Letters Patent is hereby corrected as shown below:

Column 1, line 28, after "lower" insert ---row---;

Column 2, line 6, change "chain" to ---chair---; and

Column 5, line 24, "panel" should be ---plane---.

Signed and Sealed this

*Seventh* Day of *February 1984*

[SEAL]

*Attest:*

GERALD J. MOSSINGHOFF

*Attesting Officer*

*Commissioner of Patents and Trademarks*